US006904765B2

(12) United States Patent
Lee et al.

(10) Patent No.: US 6,904,765 B2
(45) Date of Patent: Jun. 14, 2005

(54) STRUCTURE FOR DISPENSING ICE IN REFRIGERATOR

(75) Inventors: Wook Yong Lee, Gwangmyeong-si (KR); Seung Hwan Oh, Seoul (KR); Eui Yeop Chung, Seoul (KR); Myung Ryul Lee, Sungnam-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/464,503

(22) Filed: Jun. 19, 2003

(65) Prior Publication Data

US 2004/0237569 A1 Dec. 2, 2004

(30) Foreign Application Priority Data

May 28, 2003 (KR) ..... P2003-0034082

(51) Int. Cl.[7] ..... F25C 5/18
(52) U.S. Cl. ..... 62/320; 62/344
(58) Field of Search ..... 62/344, 320

(56) References Cited

U.S. PATENT DOCUMENTS 5,056,688 A * 10/1991 Goetz et al. ..... 222/146.6
5,473,911 A * 12/1995 Unger ..... 62/344
6,050,097 A * 4/2000 Nelson et al. ..... 62/137
6,082,130 A * 7/2000 Pastryk et al. ..... 62/344
6,135,173 A * 10/2000 Lee et al. ..... 141/361
6,148,624 A * 11/2000 Bishop et al. ..... 62/137
6,286,324 B1 * 9/2001 Pastryk et al. ..... 62/137
6,314,745 B1 11/2001 Janke et al.
6,351,958 B1 3/2002 Pastryk et al.
6,425,259 B2 * 7/2002 Nelson et al. ..... 62/344
6,442,954 B1 * 9/2002 Shapiro et al. ..... 62/137

* cited by examiner

*Primary Examiner*—William E. Tapolcai
(74) *Attorney, Agent, or Firm*—Greenblum & Bernstein, P.L.C.

(57) ABSTRACT

Disclosed is a structure for dispensing ice in a refrigerator, in which an automated ice-making device and an ice bank are installed at a door of a freezing chamber to thereby make its space utilization effectively. The structure of the present invention includes: an ice-making device installed in a door of a freezing chamber; an ice bank storing pieces of ice provided from the ice-making device; an ice transfer unit for transferring the pieces of the ice stored in the ice bank in a width direction; and an ice crushing part for crushing the pieces of the ice transferred by the ice transfer unit.

20 Claims, 8 Drawing Sheets

STRUCTURE FOR DISPENSING ICE IN REFRIGERATOR

This application claims the benefit of the Korean Application No. P2003-0034082 filed on May 28, 2003, which is hereby incorporated by reference.

BACKGROUND OF THE INVENTION

1. Field of the Invention

The present invention relates to a structure for dispensing an ice in a refrigerator, and more particularly, to a structure for dispensing an ice in a refrigerator, which includes an automated ice-making device for manufacturing pieces of ice and an ice bank for keeping pieces of ice.

2. Description of the Related Art

In general, a refrigerator is divided into a freezing chamber and a chilling chamber. The chilling chamber is maintained at temperature of 3° C. to 4° C., to keep foods or vegetables in a fresh state. The freezing chamber is maintained at a temperature below 0° C., to keep foods in a frozen state.

Recently, various functions are added to the refrigerator so that a user can use it conveniently. Among them, one function is an automated ice-making device.

FIG. 1 is a perspective view showing an example of an automated ice-making device installed in a freezing chamber of a conventional two-door refrigerator, and FIG. 2 is a sectional view taken along the line I—I of FIG. 1.

As shown, the automated ice-making device 1 includes an ice-making chamber 11 for making pieces of ice, and a water supply part 12 provided at one side of the ice-making chamber 11 to supply water to the ice-making chamber 11.

In addition, the automated ice-making device 1 includes a control part 13 accommodating a motor (not shown) at the other side of the ice-making chamber 11, and an ejector 14 rotatably connected to a shaft of the motor accommodated in the control part 13 to dispense the pieces of ice made in the ice-making chamber 11 to an ice bank 19.

A structure of the automated ice-making device 1 will be described below in detail. A coupling part 15 for coupling the automated ice-making device 1 to the freezing chamber of the refrigerator is formed at a rear side portion of the automated ice-making device 1. The ice-making chamber 11 defining an ice-making space is provided at a body of the automated ice-making device 1.

The ice-making chamber 11 is in a hemicylinder shape. Partitioning protrusions 16 for separating and dispensing the pieces of ice are formed at an inner surface of the hemicylinder-shaped ice-making chamber 11.

As described above, the motor is installed inside the control part 13 formed at one portion of the ice-making chamber 11, and the ejector 14 is coupled to the shaft of the motor.

A shaft of the ejector 14 is formed across a center of the ice-making chamber 11, and a plurality of ejector pins 14*a* are formed at a side surface of a shaft of the ejector 14. The ejector pins 14*a* are formed spaced apart from each other and provided as many as the number of sections partitioned by the partitioning protrusions 16 of the ice-making chamber 11.

The ejector pin 14*a* is means for dispensing the pieces of ice to the ice bank 19.

A slide bar 17 is provided at an upper portion of a front hemicylinder of the ice-making chamber 11, which is approximately halved on center of the ejector 14. The pieces of ice slide down the slide bar 17 toward the ice bank 19. The pieces of ice moved by the ejector pins 14*a* are loaded on the slide bar 17, slide down the slide bar 17, and then are dropped into the ice bank 19.

A heater 18 is attached to a lower surface of the ice-making chamber 11. In order to transfer the pieces of ice, they must be separated from the inner surface of the ice-making chamber 11. The heater 18 increases a temperature of the inner surface of the ice-making chamber 11 to melt the pieces of ice, which are fixedly attached to a surface of the ice-making chamber, such that the pieces of ice are easily separated from the ice-making chamber 11. The separated ice is moved by the ejector 14 and the ejector pins 14*a*.

As shown in FIGS. 3 and 4, such a conventional automated ice-making device is installed inside the refrigerator and generally fixed to rear wall or side wall inside the freezing chamber. Most refrigerators with the automated ice-making device 1 include a dispenser 21 for allowing a user to directly obtain the ices kept in the ice bank 19 without opening a door 2 of the refrigerator.

Generally, the dispenser 21 is disposed at the door 2 and the automated ice-making device 1 is disposed inside the freezing chamber. Therefore, there are problems that the automated ice-making chamber 1 occupies a large inner space of the freezing chamber 1. In other words, the automated ice-making device 1 is provided with the ice bank 19 as well as the ice-making chamber 11, and an ice transfer unit (not shown) for transferring the pieces of ice to the dispenser 21 and an ice crushing part (not shown) are installed in the ice bank 19, thus occupying a large space of the freezing chamber.

Since the automated ice-making device 1 and the ice bank 19 occupy about 20% or more of the inner space of the freezing chamber, thus limiting the utilization of the inner space of the freezing chamber.

Meanwhile, in order to solve the problems, there has been proposed a refrigerator having an automated ice-making device and an ice bank, both of which are installed at a door of a conventional freezing chamber.

In the above art, the ice transfer unit of the ice bank has an auger installed in a vertical direction and employs a method of moving pieces of ice downwardly. To this end, if the pieces of ice are not discharged for a long time, the pieces of ice are fixedly attached between the augers, thus causing a problem that the augers do not operate.

SUMMARY OF THE INVENTION

Accordingly, the present invention is directed to a structure for dispensing ice in a refrigerator that substantially obviates one or more problems due to limitations and disadvantages of the related art.

An object of the present invention is to provide a structure for dispensing an ice in a refrigerator, in which an automated ice-making device and an ice bank are installed at a door of a freezing chamber to thereby enable an effective utilization of the freezing chamber space and prevent a malfunction when transferring pieces of ice.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a structure for dispensing ice in a refrigerator comprises: an ice-making device installed in a door of a freezing chamber; an ice bank storing pieces of ice provided from the ice-making device; an ice transfer unit for transferring the pieces of the ice stored in the ice bank in a width direction; and an ice crushing part for crushing the pieces of the ice transferred by the ice transfer unit.

Preferably, the ice-making device includes a water-overflow preventing part, and the ice bank is provided at the door of the freezing chamber.

The ice transfer unit includes a transfer means and a rotating means for rotating the transfer means. Specifically, the transfer means is a spiral auger, and the rotating means is a motor. Preferably, the auger is installed inside the ice bank in a width direction.

The ice crushing part is formed at one end of the auger and includes a fixed blade and a rotating blade. The rotating blade is coupled to the auger of the ice transfer unit and rotates together with the auger.

Preferably, an ice discharge opening is provided at a bottom surface of the ice bank in order to discharge pieces of ice and includes a damper for opening/closing the ice discharge opening.

The ice discharge opening is formed under the ice crushing part and the ice bank is coupled to a dispenser which is formed at the door of the freezing chamber. Preferably, the dispenser includes a large-sized ice selecting part and a small-sized ice selector part.

Preferably, a control part for controlling the ice transfer unit and the damper is provided.

In case the large-sized ice selecting part of the dispenser is selected, the control part operates the motor of the ice transfer unit to open the damper, and when the small-sized ice selecting part of the dispenser is selected, the control part operates the motor of the ice transfer unit to close the damper for a predetermined selected time and then open the damper to thereby discharge the ice.

According to another embodiment of the present invention, the ice discharge opening is provided with a first ice discharge opening and a second ice discharge opening. In this case, there are provided two dampers, i.e., a first damper and a second damper. The first ice discharge opening is formed under the ice transfer unit, and the second ice discharge opening is formed under the ice crushing part.

A control part for controlling the two dampers and the ice transfer unit is provided. In case the large-sized ice selecting part of the dispenser is selected, the control part operates the first damper to open the first ice discharge opening and operates the second damper to close the second ice discharge opening. Meanwhile, when the small-sized ice selecting part of the dispenser is selected, the control part operates the first damper to close the first ice discharge opening and operates the second ice discharge opening to open the second ice discharge opening.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 5:
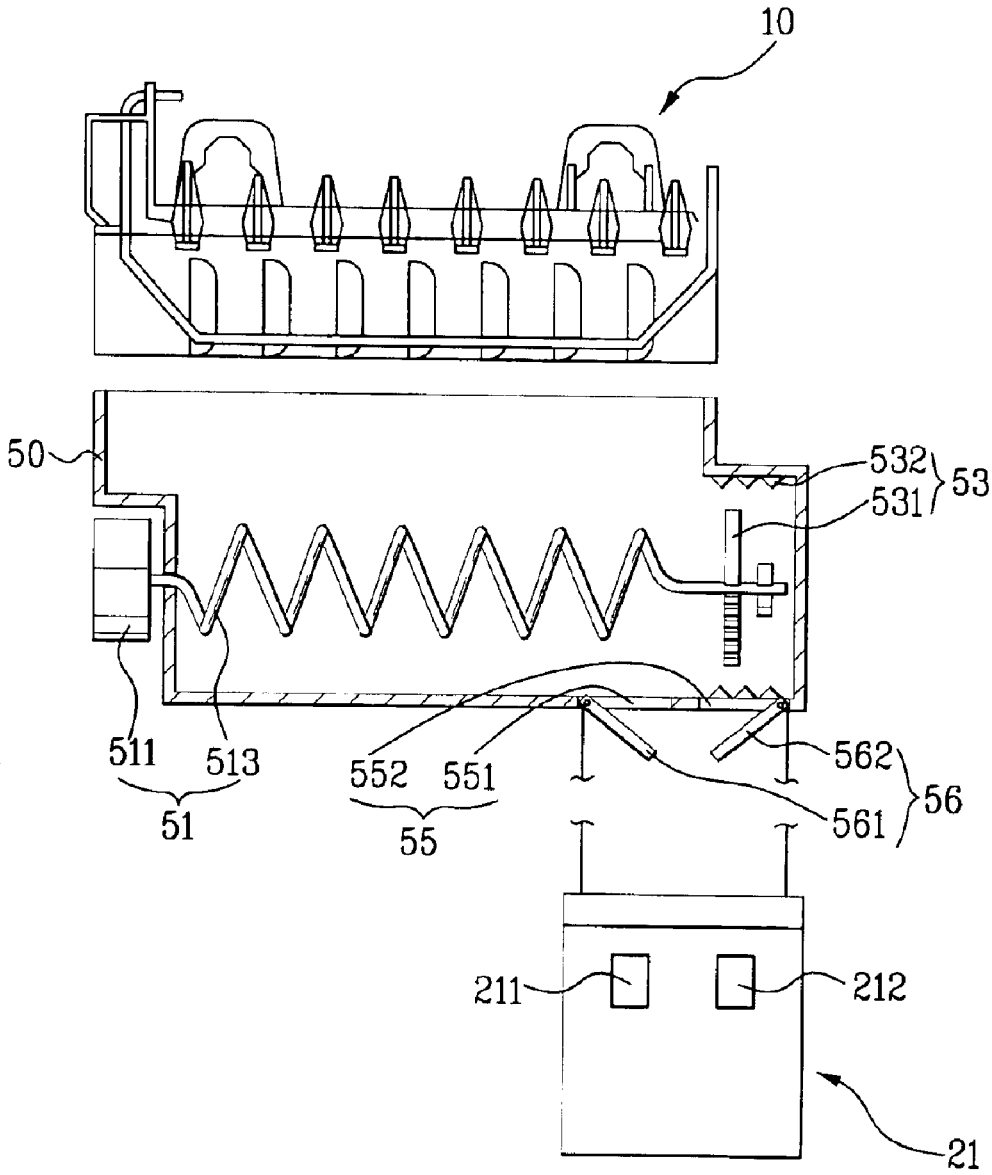
FIG. 5 is a schematic sectional view of an automated ice-making device and an ice bank in a structure for dispensing pieces of ice in a refrigerator according to the present invention.
Figure 6:
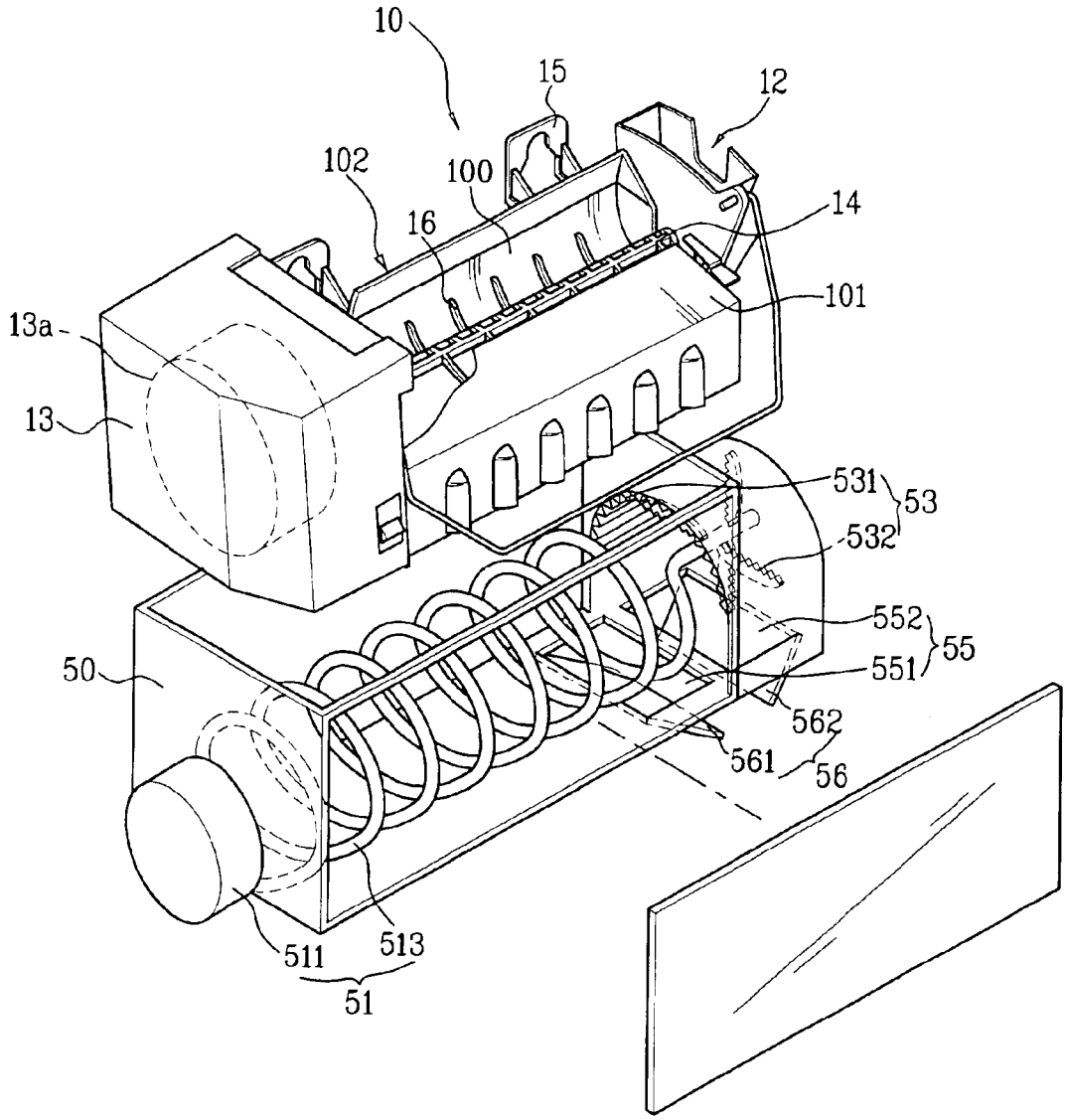
FIG. 6 is a schematic perspective view of the automated ice-making device and the ice bank according to the present invention.
Figure 7:
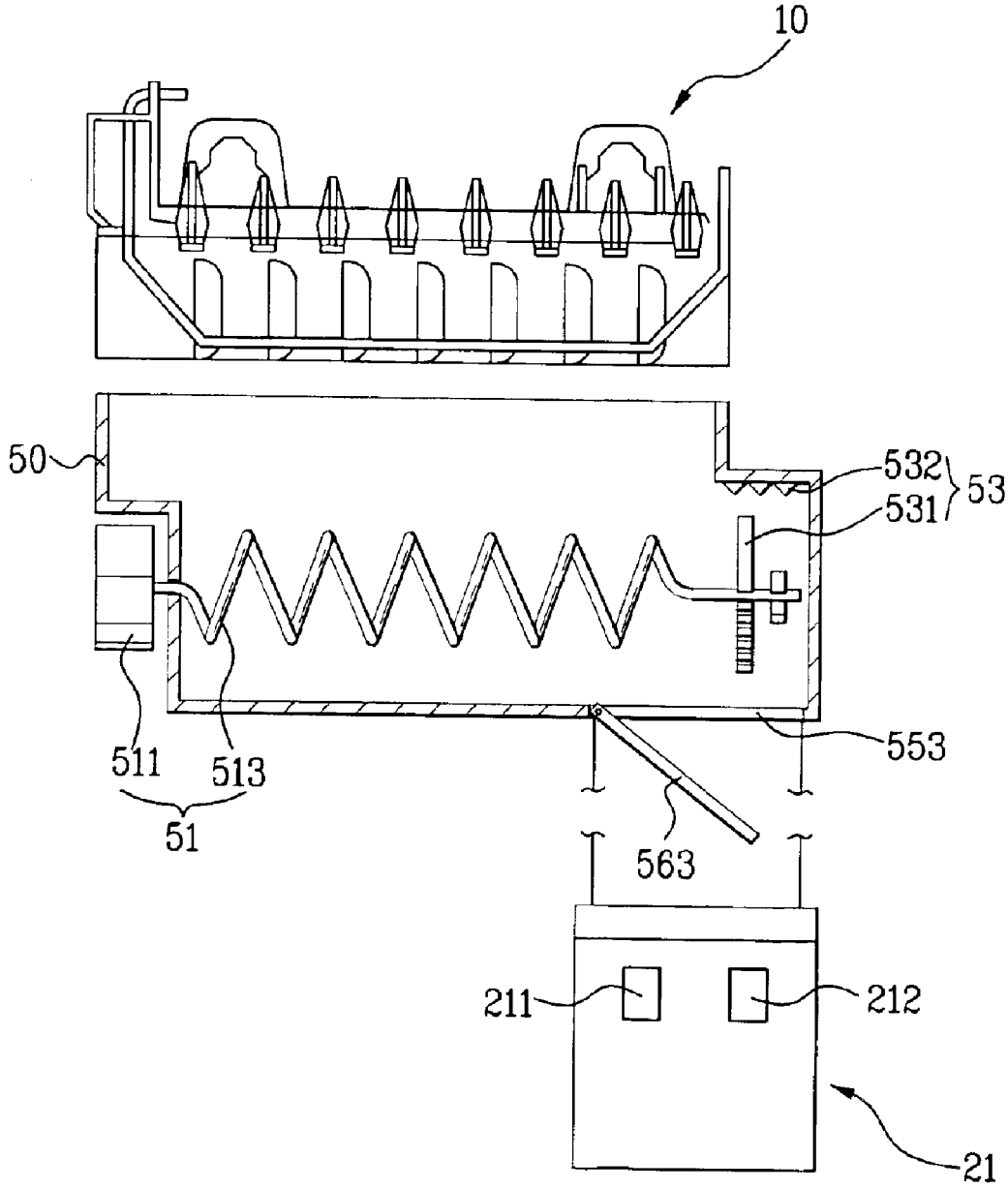
FIG. 7 is a sectional view of an ice bank according to another embodiment of the present invention.

FIG. 5 is a schematic sectional view of an automated ice-making device 10 and an ice bank 50 in a structure for dispensing pieces of ice in a refrigerator according to the present invention. FIG. 6 is a schematic perspective view of the automated ice-making device and the ice bank 50 according to the present invention. FIG. 7 is a sectional view of an ice bank 500 according to another embodiment of the present invention.

As shown in FIGS. 5 and 6, the ice bank 50 is installed at a lower portion of the automated ice-making device 10. Since the automated ice-making device 10 is formed at a door 2, water-overflow preventing parts 101 and 102 are formed in order to prevent an overflowing of water in an ice-making chamber according to opening/closing of the door 2.

Figure 1:
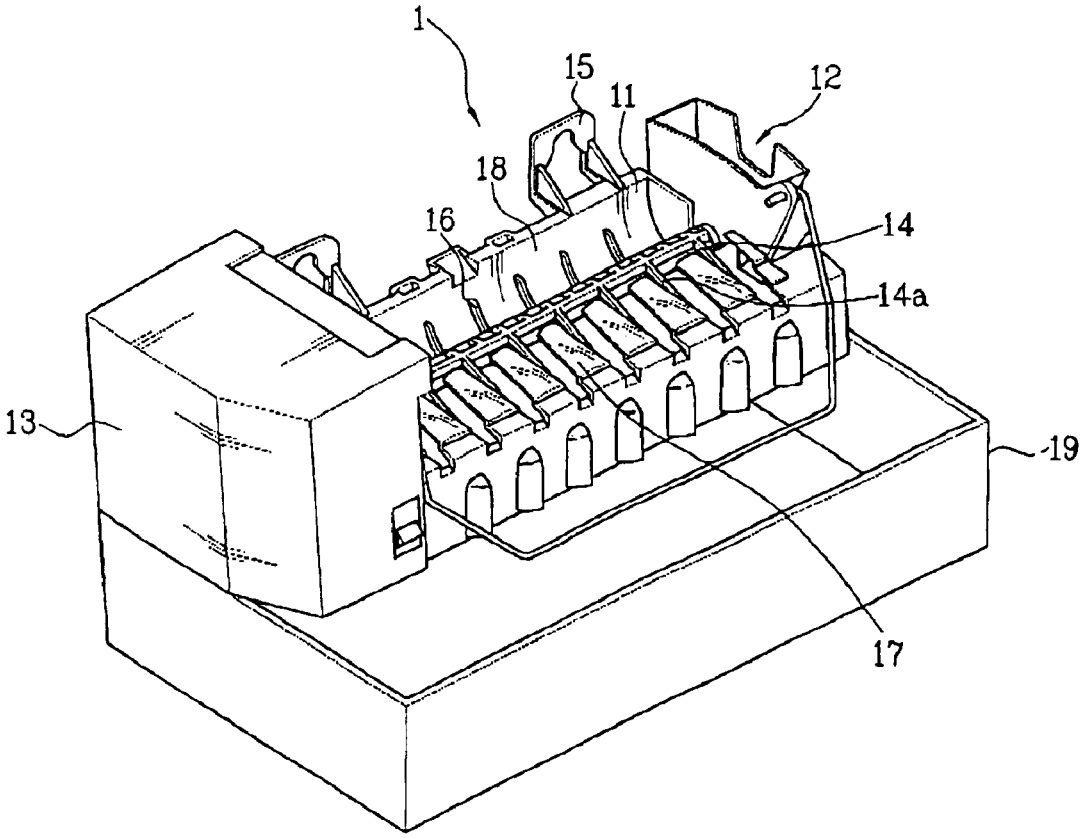
FIG.1 Prior Art
FIG. 1 is a perspective view showing an example of an automated ice-making device 1 and an ice bank, which are attached to a freezing chamber of a conventional two-door refrigerator.
Figure 2:
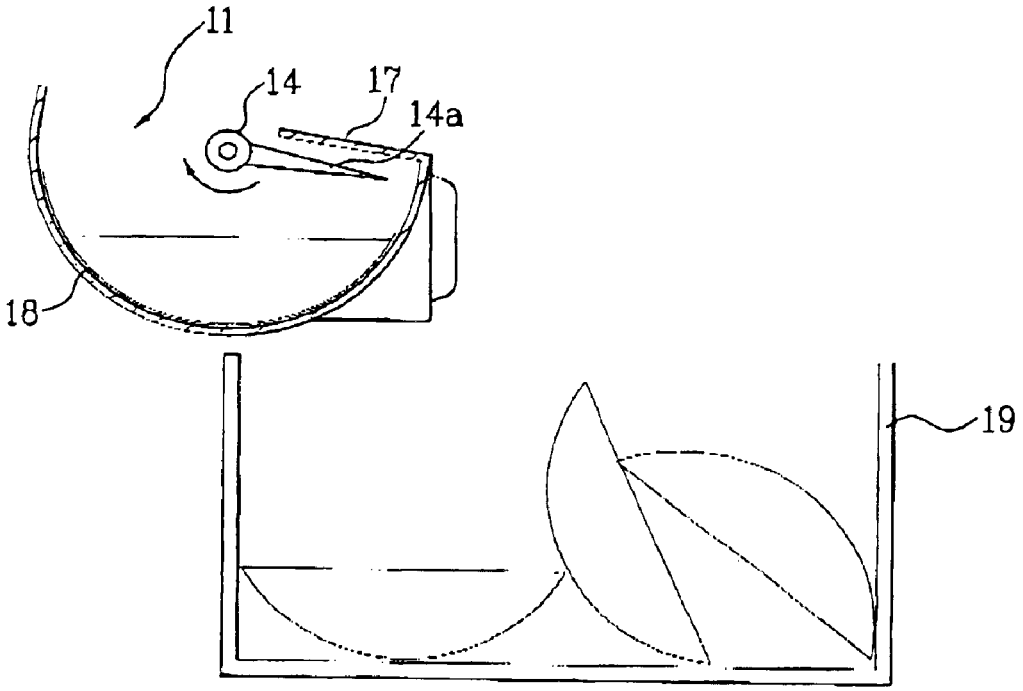
FIG. 2 Prior Art
FIG. 2 is a sectional view taken along the line I—I.
Figure 3:
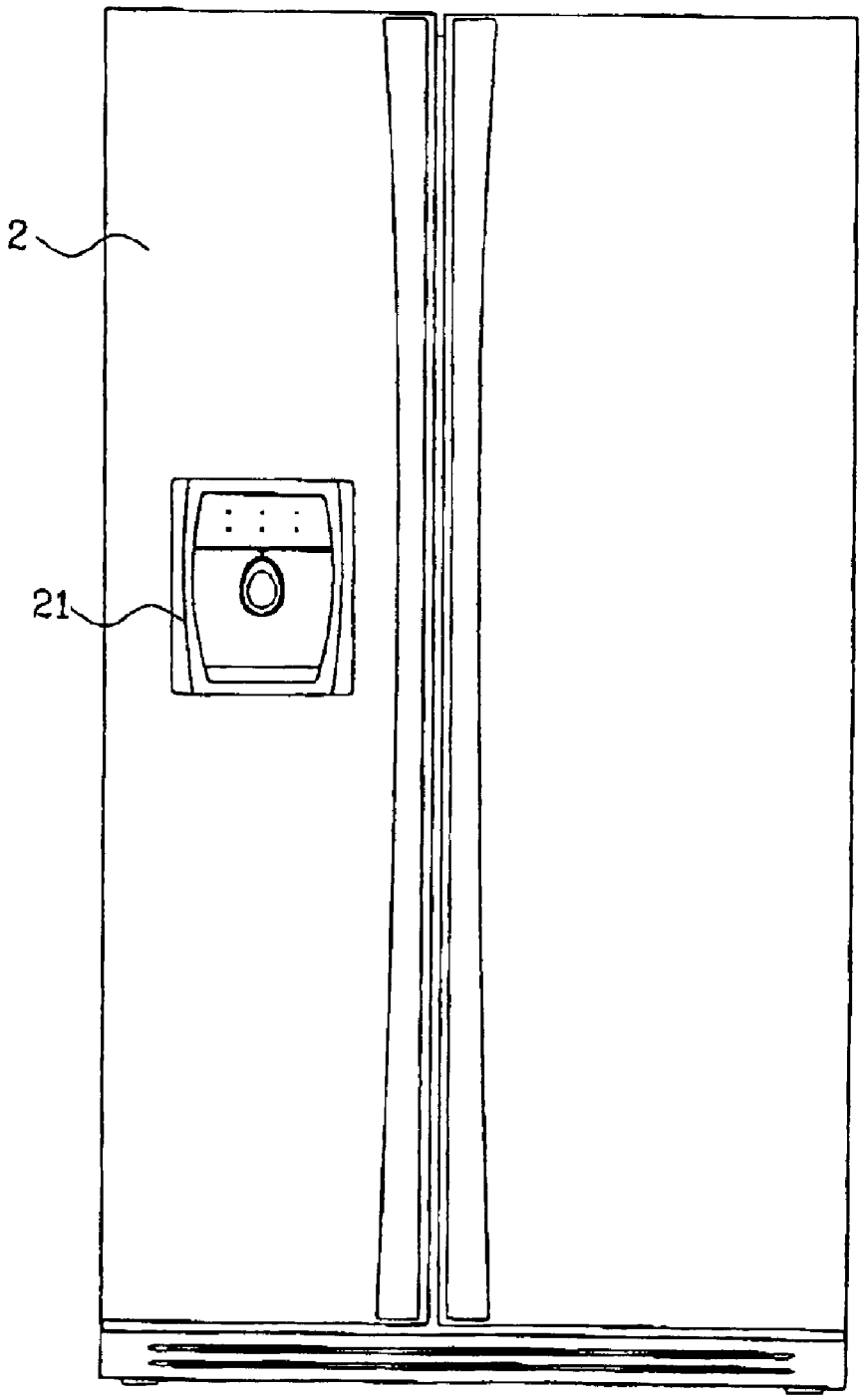
FIG. 3 Prior Art
FIGS. 3 and 4 are a schematic plan view and a perspective view of a refrigerator having an automated ice-making device and an ice bank of FIG. 1, respectively.
Figure 4:
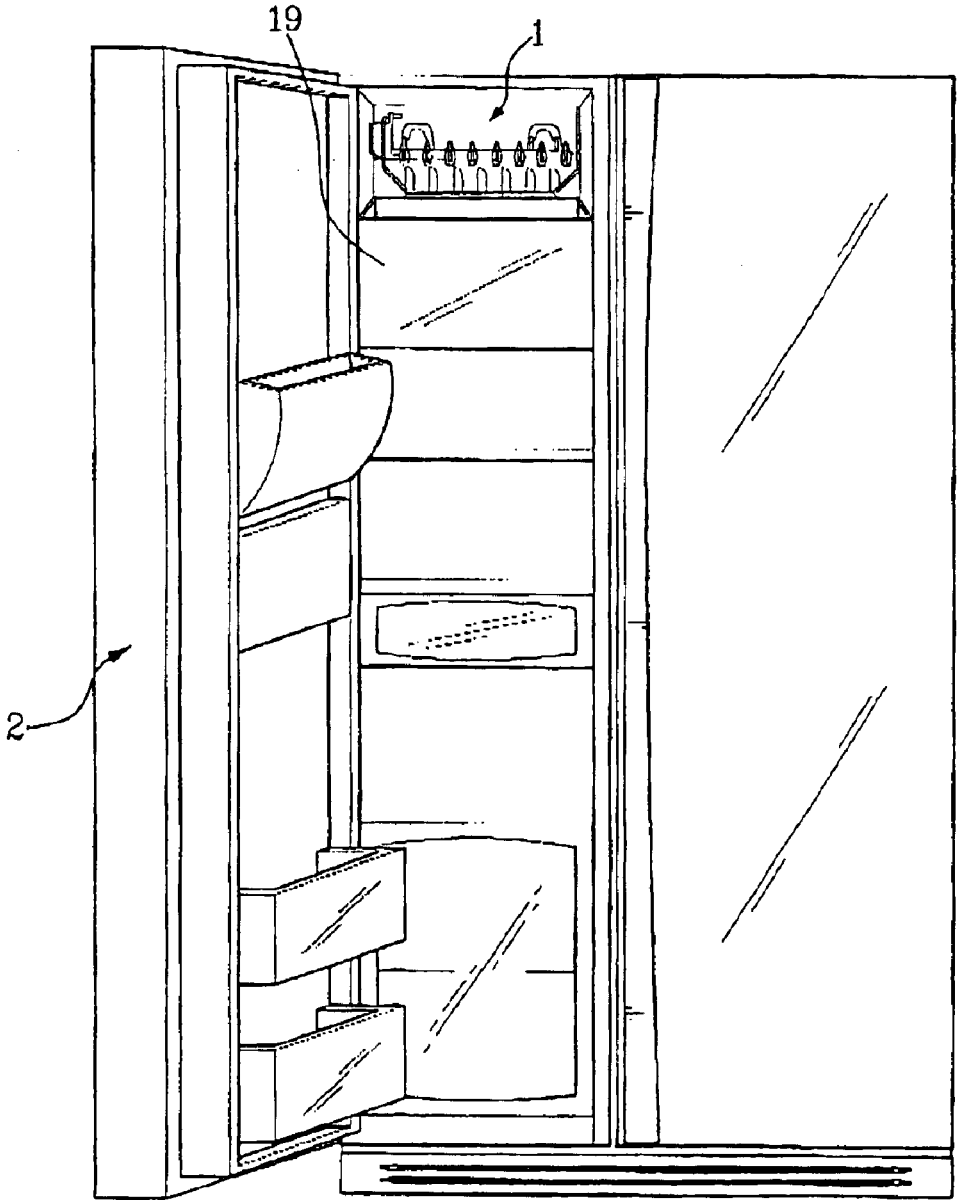
FIG. 4 Prior Art

In other words, the first water-overflow preventing part 101 is formed in a panel shape at a position in which the slide bar of the conventional ice-making chamber (refer to FIG. 1) is disposed, and the second water-overflow preventing part 102 is extendedly formed in an arc shape at an opposite side of the first water-overflow preventing part 101, thereby preventing the overflowing of water according to a movement of the door 2.

The ice bank 50 has a storage space in which pieces of ice dispensed from the automated ice-making device 10 are stored. An ice transfer unit 51 and an ice crushing part 53 are installed inside the ice bank 50.

The ice transfer unit 51 is means for transferring pieces of ice, which are stored in the ice bank 50, to an ice discharge opening by operating a lever 21*a* of a dispenser 21 for the purpose of eating the pieces of ice.

The ice transfer unit 51 includes a winding transfer means for directly transferring the pieces of ice, and a rotating means for rotating the transfer means. The transfer means is an auger 513 made of a spiral metal rod or a plastic rod, and the rotating means is a motor 511.

A shaft of the motor 511 is coupled to one end of the auger 513. The auger 513 is a metal construction in which a spiral metal rod is rotatably coupled to the shaft of the motor. The auger 513 can be made of synthetic resin such as plastics, except metal.

The pieces of ice dropped into the ice bank 50 are placed among the metal rods of the auger 513. Since the auger 513 is in the spiral shape, the ice disposed inside the auger 513 moves forward if the auger 513 is rotated by the motor 511.

The pieces of the ice moving forward are dispensed through the ice discharge opening 56 and dropped into the dispenser 21 coupled to the ice discharge opening 56.

According to the present invention, the auger 513 of the ice transfer unit 51 is installed in a width direction, and the ice crushing part 53 is installed in the ice bank 50 together with the ice transfer unit 51.

As described in the related art, the pieces of the ices made in the automated ice-making device 10 are formed in hemispherical shapes, thus occupying a large volume. Here, the piece of the ice having the large volume is referred to as "large-sized ice". People rarely put the large-sized ice in drinking water or food. Instead, after crushing the large-sized ice into the "small-sized" ice, people put the small-sized ice in drinking water.

The ice crushing part for crushing the large-sized ice into the small-sized ice is installed at the end of the auger 513 and includes a plurality of blades 531 and 532, such that transferred ice is crushed between the blades 531 and 532.

The blades 531 and 532 can perform the crushing function if any one of a rotating blade 531 and a fixed blade 532 is provided. However, it is preferable to provide both the rotating blade 531 and the fixed blade 532 at the same time.

Preferably, the rotating blade 531 is formed at one end of the auger 513 and thus rotates simultaneously when the auger 513 rotates. In addition, preferably, the fixed blade 532 is installed spaced apart from the rotating blade 531 by a predetermined interval, or it is installed in a circumference direction. In this case, a crushing effect may be improved.

Ice discharge openings 551 and 552 are formed at a lower portion of the ice bank 50. One or two ice discharge openings 551 and 552 can be provided. As a first embodiment of the present invention, there are provided two ice discharge openings 551 and 552.

As shown in FIG. 6, the first ice discharge opening 551 is formed on a bottom surface of the ice bank 50 under the end portion of the auger 513 transferring the pieces of ice, and the second ice discharge opening 552 is formed on a bottom surface of the ice bank 50 under the ice crushing part 53.

The first ice discharge opening 551 is a discharge opening which is opened when a user wants to a large-sized ice. In this case, the piece of ice moving along the auger 513 is dropped into the dispenser 21 before it is transferred to the blades 531 and 532.

The second ice discharge opening 552 is a discharge opening which is opened when a user wants a small-sized ice crushed by the ice crushing part 53. In this case, the pieces of ice are crushed by the blades 531 and 532 and then dropped into the dispenser 21.

A first damper 561 is provided at the first ice discharge opening 551. The first damper 561 is means for opening/closing the first ice discharge opening 501. A second damper 562 is provided at the second ice discharge opening 552. The second damper 552 is means for opening/closing the second ice discharge opening 552.

A large-sized ice selecting part 211 and a small-sized ice selecting part 212 are formed at the dispenser 21 provided at the door 2. The large-sized ice selecting part 211 is a part which is selected when a user wants a large-sized ice, and the small-sized ice selecting part 212 is a part which is selected when a user wants a small-sized ice.

Although not shown, the refrigerator includes a control part for controlling the first damper 561 and the second damper 562 when selecting the large-sized selecting part 211 and the small-sized selecting part 212.

Hereinafter, detailed description on functions of the control part will be made.

If a user selects the large-sized selecting part 211 of the dispenser 21, the control part operates the first damper 561 to open the first ice discharge opening 551 and operates the second damper 561 to close the second ice discharge opening 552.

The control part operates the motor 511 of the ice transfer unit 51 to rotate the auger 513. According to the rotation of the auger 513, pieces of the large-sized ice stored in the ice bank 50 are transferred toward the first ice discharge opening 551. Since the first ice discharge opening 551 is opened by the first damper 561, the pieces of the large-sized ice are dispensed through the first ice discharge opening 551 and dropped into the dispenser 21.

If a user selects the small-sized selecting part 212 of the dispenser 21 in order to obtain the crushed ice, the control part operates the first damper 561 to close the first ice discharge opening 551 and operates the second damper 561 to open the second ice discharge opening 552.

The control part operates the motor 511 of the ice transfer unit 51 to rotate the auger 513. According to the rotation of the auger 513, pieces of the large-sized ice stored in the ice bank 50 are transferred. Since the first ice discharge opening 551 is closed by the first damper 561, the pieces of the large-sized ice are transferred to the ice crushing part 53, not being dispensed through the first ice discharge opening 551.

The pieces of the large-sized ice are crushed by the rotating blade 531 and the fixed rotating blade 532 of the ice crushing part 53 and then dropped into the dispenser 21 through the second ice discharge opening 502.

Although the embodiment of the present invention shows that the large-sized ice and the small-sized ice are dropped through the different openings by forming two ice discharge openings 551 and 552, the large-sized ice and the small-sized ice can be discharged using a single ice discharge opening 553 and a single damper 563.

In other words, as shown in FIG. 7, the large-sized ice and the small-sized ice can be selectively discharged through a single ice discharge opening 503.

As shown, an ice bank 50 according to another embodiment of the present invention includes a single ice discharge opening 553 formed on a bottom surface, and a damper 563 for opening/closing the ice discharge opening 553.

If a user selects the large-sized selecting part 211 of the dispenser 21 in order to obtain the large-sized ice, the damper 563 is operated to open the ice discharge opening 553. Since the ice discharge opening 553 is opened, the large-sized ice transferred through the auger 513 is dropped through the ice discharge opening 553 and then dispensed through the dispenser 21 before it is crushed by the blades 531 and 532 of the ice crushing part 53.

If a user selects the small-sized selecting part 212 of the dispenser 21 in order to obtain the small-sized ice, the damper 563 is operated to close the ice discharge opening 553. Since the ice discharge opening 553 is closed, the large-sized ice transferred through the auger 513 is crushed between the rotating blade 531 and the fixed blade 532 of the ice crushing part 53.

After carrying out the crushing operation for a predetermined time, the damper 563 is opened, such that the crushed ice is discharged to the dispenser 21. The crushing time can be appropriately controlled by the control part. Further, it is possible to obtain a larger amount of the small-sized ice by repeating the above procedures.

Figure 8:
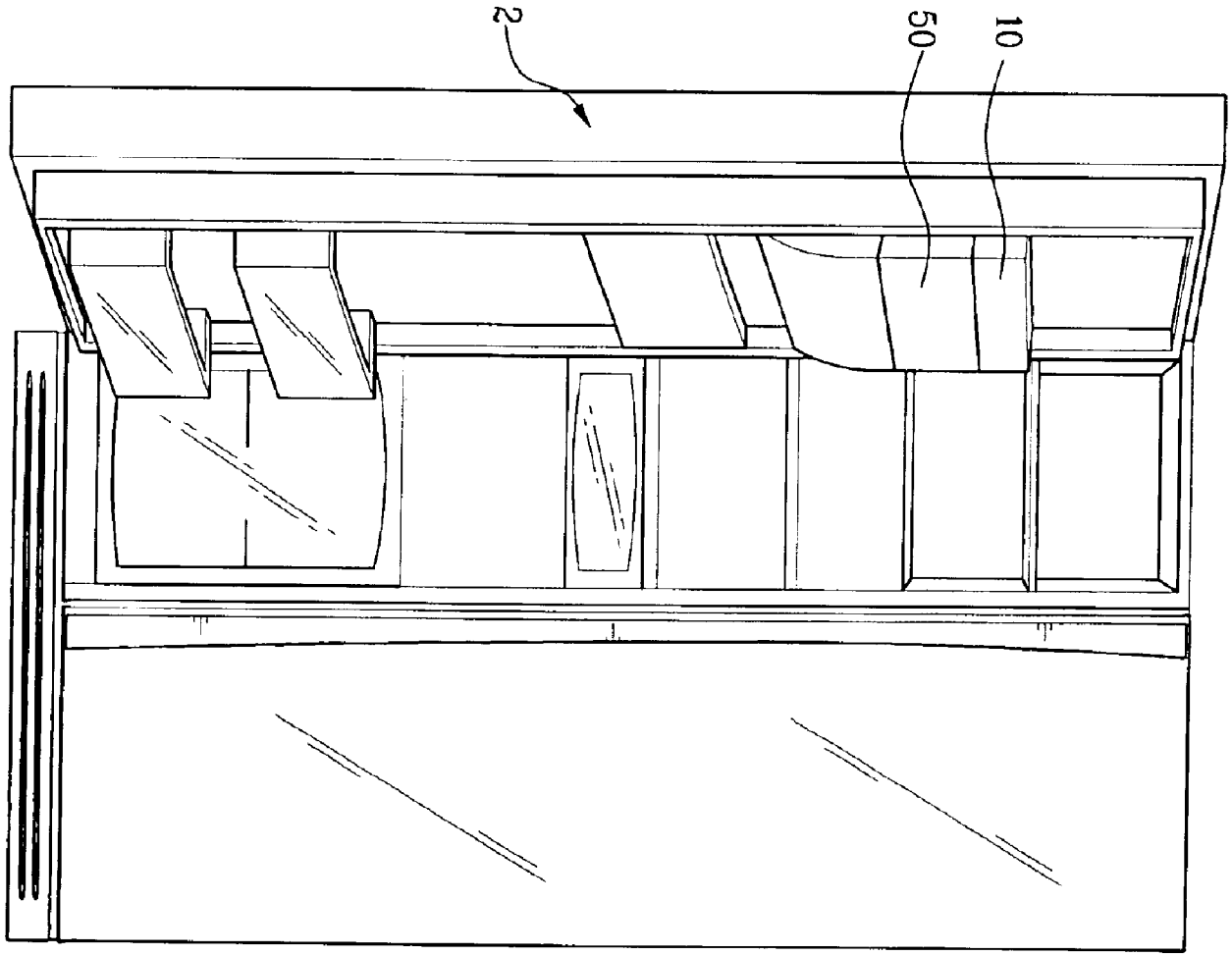
FIG. 8 is a perspective view of a refrigerator having the structure for dispensing pieces of ice according to the present invention.

FIG. 8 is a perspective view of the refrigerator according to the present invention, showing that the automated ice-making device 10 and the ice bank 50 are installed in the door 2 of the refrigerator.

As shown in FIG. 7, according to the present invention, the automated ice-making device 10 and the ice bank 50 are installed in parallel in a width direction with respect to the freezing chamber door, so that a storage space of the ice bank 50 is expanded. Further, since the auger 513 is installed in the width direction, the auger 513 is lengthened and a space is widened. Therefore, it is possible to prevent a malfunction of the auger, which is caused due to the ice.

In the refrigerator of the present invention, both the automated ice-making device and the ice bank are installed in the width direction with respect to the freezing chamber door, which does not influence a thickness of the freezing chamber door. Further, compared with the case the ice bank is installed in a length direction, the storage space is widened so that a large amount of ice is stored.

Furthermore, since the auger of the ice transfer unit is installed in a width direction and there is an affordable space, it is possible to solve the malfunction of the auger due to the ice. A user can selectively eat pieces of ice having different size.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A structure for dispensing pieces of ice in a refrigerator, comprising:

an ice-making device installed in a door of a freezing chamber;

an ice bank that stores pieces of ice which are made in and dispensed from the ice-making device;

an ice transfer unit that transfers the pieces of the ice stored in the ice bank in a generally horizontal direction; and an ice crushing part that crushes the pieces of the ice transferred by the ice transfer unit; and an ice discharge opening provided at a bottom surface of the ice bank to discharge pieces of ice, wherein the ice discharge opening comprises a damper that opens/closes the ice discharge opening.

2. The structure of claim 1, wherein the ice-making device comprises a water-overflow preventing part.

3. The structure of claim 1, wherein the ice bank is provided at the door of the freezing chamber.

4. The structure of claim 1, wherein the ice transfer unit comprises a transfer device and a rotating device that rotates the transfer device.

5. The structure of claim 4, wherein the rotating device is installed outside the ice bank and the transfer device comprises an auger installed inside the ice bank in a horizontal direction.

6. The structure of claim 5, wherein the ice crushing part is formed at one end of the auger.

7. The structure of claim 1, wherein the ice crushing part comprises a fixed blade and a rotating blade.

8. The structure of claim 7, wherein the rotating blade is coupled to the ice transfer unit, wherein the ice transfer unit comprises a spiral auger coupled to the rotating blade, and the rotating blade rotates together with the auger.

9. The structure of claim 1, wherein the ice discharge opening is formed under the ice crushing part.

10. The structure of claim 1, wherein the ice bank is coupled to a dispenser, the dispenser being at the door of the freezing chamber.

11. The structure of claim 1, further comprising a control part that controls the ice transfer unit and the damper.

12. The structure of claim 11, wherein in case a large-sized ice is selected, the control part operates the damper to open the ice discharging opening, and when a small-sized ice is selected, the control part operates the damper to close the ice discharge opening for a predetermined selected time and then open the ice discharge opening.

13. A structure for dispensing pieces of ice in a refrigerator, comprising:

an ice-making device installed in a door of a freezing chamber;

an ice bank that stores pieces of ice which are made in and dispensed from the ice-making device;

an ice transfer unit that transfers the pieces of the ice stored in the ice bank in a generally horizontal direction;

an ice crushing part that crushes the pieces of the ice transferred by the ice transfer unit; and an ice discharge opening provided at a bottom surface of the ice bank to discharge pieces of ice, wherein the ice discharge opening is provided with a first ice discharge opening and a second ice discharge opening.

14. The structure of claim 13, wherein the first ice discharge opening and the second ice discharge opening comprise a first damper and a second damper respectively.

15. The structure of claim 13, wherein the first ice discharge opening is formed under the ice transfer unit, and the second ice discharge opening is formed under the ice crushing part.

16. The structure of claim 14, further comprising a control part that controls the two dampers and the ice transfer unit.

17. The structure of claim 14, wherein the first and second ice discharge openings are coupled to a dispenser, the dispenser being formed on the door of the refrigerator.

18. The structure of claim 17, wherein the dispenser comprises:

a large-sized ice selecting part that selects an ice which is in an original state; and a small-sized ice selecting part that selects the ice which is in a crushed state.

19. The structure of claim 16, wherein the first damper is operated by the control part to open the first ice discharge opening discharging a large-sized ice, and the second damper is operated by the control part to open the second ice discharge opening discharging a small-sized ice.

20. The structure of claim 18, wherein in case the large-sized ice selecting part of the dispenser is selected, the first damper opens the first ice discharge opening and the second damper closes the second ice discharge opening, and when the small-sized ice selecting part of the dispenser is selected, the first damper closes the first ice discharge opening and the second damper opens the second ice discharge opening.

* * * * *

UNITED STATES PATENT AND TRADEMARK OFFICE

CERTIFICATE OF CORRECTION

PATENT NO. : 6,904,765 B2
DATED : June 14, 2005
INVENTOR(S) : W. Y. Lee et al.

It is certified that error appears in the above-identified patent and that said Letters Patent is hereby corrected as shown below:

Column 7,
Line 43, after "tion;" delete "and".

Signed and Sealed this

Seventh Day of February, 2006

JON W. DUDAS
*Director of the United States Patent and Trademark Office*